US010626861B2

(12) United States Patent
Takeuchi

(10) Patent No.: US 10,626,861 B2
(45) Date of Patent: Apr. 21, 2020

(54) BLOWER

(71) Applicant: Murata Manufacturing Co., Ltd., Nagaokakyo-shi, Kyoto-fu (JP)

(72) Inventor: Susumu Takeuchi, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 739 days.

(21) Appl. No.: 14/548,431

(22) Filed: Nov. 20, 2014

(65) Prior Publication Data

US 2015/0071797 A1 Mar. 12, 2015

Related U.S. Application Data

(63) Continuation of application No. PCT/JP2013/065321, filed on Jun. 3, 2013.

(30) Foreign Application Priority Data

Jun. 11, 2012 (JP) ..... 2012-131542

(51) Int. Cl.
*F04B 43/04* (2006.01)
*F04B 43/00* (2006.01)
(Continued)

(52) U.S. Cl.
CPC ..... *F04B 43/046* (2013.01); *F04B 43/0027* (2013.01); *F04B 43/0054* (2013.01);
(Continued)

(58) Field of Classification Search
CPC ..... F04B 43/02; F04B 43/021; F04B 43/023; F04B 43/025; F04B 43/026; F04B 43/028;
(Continued)

(56) References Cited

U.S. PATENT DOCUMENTS

2005/0074662 A1 4/2005 Cho et al.
2009/0162720 A1* 6/2009 Nishikawa ..... F04D 33/00 429/406
2009/0175741 A1* 7/2009 Jost ..... F25B 31/002 417/312
2011/0070109 A1* 3/2011 Kanai ..... F04B 45/047 417/410.2
(Continued)

FOREIGN PATENT DOCUMENTS

JP 2005-113918 A 4/2005
JP 2009-156253 A * 7/2009
(Continued)

OTHER PUBLICATIONS

145484331—JP20092500132—Espacnet Translatin.*
Official Communication issued in International Patent Application No. PCT/JP2013/065321, dated Jul. 9, 2013.

*Primary Examiner* — Alexander B Comley
(74) *Attorney, Agent, or Firm* — Keating & Bennett, LLP

(57) ABSTRACT

A piezoelectric blower includes a housing, top plate, side plate, vibrating plate, piezoelectric element, and cap. The top plate, side plate, and vibrating plate define a blower chamber. The top plate includes a vent hole. The vibrating plate and piezoelectric element constitutes a piezoelectric actuator. The cap includes a wall portion facing the piezoelectric actuator and has a disc-shaped suction port. Here, a central axis of the suction port extending along a thickness direction of the wall portion and a central axis of the piezoelectric element extending along the thickness direction of the wall portion do not coincide with each other. An air channel is provided among the housing, the cap, and a joined structure of the top plate, side plate, and piezoelectric actuator.

18 Claims, 11 Drawing Sheets

(51) Int. Cl.
*F04B 45/04* (2006.01)
*F04B 45/047* (2006.01)
*F04B 43/02* (2006.01)

(52) U.S. Cl.
CPC ..... *F04B 43/023* (2013.01); *F04B 45/04* (2013.01); *F04B 45/041* (2013.01); *F04B 45/047* (2013.01); *F04B 43/043* (2013.01)

(58) Field of Classification Search
CPC ..... F04B 43/46; F04B 43/14; F04B 45/041; F04B 45/043; F04B 45/045; F04B 45/047; F04B 45/10; F04B 17/03; F04B 19/006; F04B 43/0054; F04B 45/04; F04B 17/003; F04B 43/095; F04B 43/04–046; F04F 7/00
USPC ..... 417/413.2, 413.1
See application file for complete search history.

(56) References Cited

U.S. PATENT DOCUMENTS

| | | | | |
|---|---|---|---|---|
| 2011/0076170 | A1* | 3/2011 | Fujisaki | F04B 45/047 417/415 |
| 2011/0081267 | A1* | 4/2011 | McCrone | F04B 43/046 417/481 |
| 2011/0190670 | A1* | 8/2011 | Jaeb | F04B 43/046 601/6 |
| 2013/0071269 | A1 | 3/2013 | Fujisaki et al. | |

FOREIGN PATENT DOCUMENTS

| | | | | |
|---|---|---|---|---|
| JP | 2009-250132 | A | 10/2009 | |
| JP | 2009250132 | * | 10/2009 | |
| JP | 2009250132 | A * | 10/2009 | F04B 45/047 |
| JP | 2011-027079 | A | 2/2011 | |
| JP | 2011027079 | * | 2/2011 | |
| WO | 2011/040320 | A1 | 4/2011 | |

* cited by examiner

BLOWER

BACKGROUND OF THE INVENTION

1. Field of the Invention

The present invention relates to a blower that transports gas.

2. Description of the Related Art

Japanese Unexamined Patent Application Publication No. 2011-27079 discloses a micro-blower for dissipating heat generated inside a mobile electronic device or for supplying oxygen required to produce electric power in a fuel cell.

FIG. 12 is a cross-sectional view of a micro-blower 900 according to Japanese Unexamined Patent Application Publication No. 2011-27079. The micro-blower 900 includes an inner casing 2, an elastic metallic plate 5A, a piezoelectric element 5B, an outer casing 3 covering the outer side portion of the inner casing 2, and a lid member 9. The inner casing 2 is supported elastically on the outer casing 3 using a plurality of joining portions 4.

The inner casing 2 has a rectangular U-shaped cross section that is open in its lower portion. The inner casing 2 is joined to the elastic metallic plate 5A such that the opening is closed. Thus, the inner casing 2 and the elastic metallic plate 5A define a blower chamber 6. The inner casing 2 has an opening portion 8 enabling the inside and outside of the blower chamber 6 to communicate with each other. The piezoelectric element 5B is attached to a principal surface of the elastic metallic plate 5A opposite to the blower chamber 6.

The outer casing 3 has a discharge port 3A in a region that faces the opening portion 8. The outer casing 3 is provided with the lid member 9 for accommodating the inner casing 2. The lid member 9 has a suction port 9A in its central portion. The central axis passing through the center of the suction port 9A and extending along the thickness direction of the lid member 9 and the central axis passing through the center of the piezoelectric element 5B and extending along the thickness direction of the lid member 9 coincide with each other.

An influent channel 7 for air is formed between the outer casing 3 and the joined structure of the inner casing 2, elastic metallic plate 5A, and piezoelectric element 5B.

In the above-described configuration, when an alternating drive voltage is applied to the piezoelectric element 5B, the piezoelectric element 5B expands and contracts, and the expansion and contraction of the piezoelectric element 5B causes bending vibrations in the elastic metallic plate 5A. The bending distortion of the elastic metallic plate 5A causes the volume of the blower chamber 6 to periodically change.

In detail, when the alternating drive voltage is applied to the piezoelectric element 5B and the elastic metallic plate 5A is bent toward the piezoelectric element 5B, the volume of the blower chamber 6 increases. With this action, air outside the micro-blower 900 is sucked into the blower chamber 6 through the suction port 9A, influent channel 7, and opening portion 8. At this time, although there is no outflow of air from the blower chamber 6, inertial force of the air flow from the discharge port 3A to outside the micro-blower 900 is present.

Next, when the alternating drive voltage is applied to the piezoelectric element 5B and the elastic metallic plate 5A is bent toward the blower chamber 6, the volume of the blower chamber 6 decreases. With this action, the air inside the blower chamber 6 is discharged from the discharge port 3A through the opening portion 8 and influent channel 7.

At this time, the air flow discharged from the blower chamber 6 is discharged from the discharge port 3A while drawing the air outside the micro-blower 900 through the suction port 9A and the influent channel 7. Accordingly, the flow rate of air discharged from the discharge port 3A increases by the flow rate of the drawn air.

In the above-described manner, the discharge flow rate per power consumption in the micro-blower 900 increases.

However, the present inventor discovered that in the micro-blower 900 described in Japanese Unexamined Patent Application Publication No. 2011-27079, during the bending of the elastic metallic plate 5A toward the piezoelectric element 5B, an air flow BF leaking from the suction port 9A to outside the micro-blower 900 occurred.

That is, it was discovered that, because the flow rate of air drawn into the influent channel 7 is reduced by the flow rate of air leaking to outside the micro-blower 900 caused by the air flow BF, the discharge flow rate of air discharged from the discharge port 3A is reduced.

There has been a trend in recent years to reduce the power consumption in an electronic device equipped with the micro-blower having the above-described structure illustrated in FIG. 12. Thus, it is desired that the micro-blower have a high discharge flow rate with low power consumption.

SUMMARY OF THE INVENTION

Accordingly, preferred embodiments of the present invention to provide a blower that significantly increases a discharge flow rate per power consumption and achieves a necessary discharge flow rate even with low power consumption.

A blower according to a preferred embodiment of the present invention includes an actuator including a driving member and configured to perform bending vibrations in a concentric manner when a voltage is applied to the driving member, a first housing including a vent hole, the first housing and the actuator defining a blower chamber, the first housing being configured to enable an inside and an outside of the blower chamber to communicate with each other, a wall portion including a suction port and facing the actuator, and a second housing covering the actuator and the first housing with the wall portion such that a gap is disposed therebetween, and an air channel being provided among the second housing, the wall portion, and the actuator and the first housing.

The second housing preferably includes a discharge port in a location facing the vent hole, and a central axis of the suction port and a central axis of the driving member do not coincide with each other.

In this configuration, when the driving voltage is applied to the driving member, the actuator performs bending vibrations in a concentric manner by the driving member. The distortion of the actuator causes the volume of the blower chamber to periodically change, and gas in the blower chamber moves out from the vent hole. The air flow moving out from the blower chamber through the vent hole is discharged from the discharge port while drawing gas existing outside the blower through the air channel. Thus, the discharge flow rate in the blower increases by the flow rate of the drawn air.

In this configuration, the central axis passing through the center of the suction port and the central axis passing through the center of the driving member do not coincide with each other. Thus, the proportion of the area of the suction port facing the region of high vibration energy in the actuator (that is, the region of a large amount of displacement in the actuator) is lower than the corresponding one in a traditional blower in which the central axis passing through the center of the suction port and the central axis passing through the center of the driving member coincide with each other. That is, when the actuator performs bending vibrations, the flow rate of gas leaking from the air channel to outside the blower through the suction port decreases, and the flow rate of gas colliding with the wall portion increases.

The air flow colliding with the wall portion and being spread remains in the air channel. Thus, when the actuator performs bending vibrations, the flow rate of air drawn by the air flow moving out from the blower chamber through the vent hole increases. That is, the discharge flow rate of air discharged from the discharge port increases.

Accordingly, with this configuration, the discharge flow rate per power consumption is significantly increased, and the necessary discharge flow rate is achieved even with low power consumption.

A center of the driving member preferably faces a region in the wall portion other than the suction port.

In this configuration, the center, which has the highest vibration energy, of the actuator (that is, the center, which has the largest amount of displacement, of the actuator) faces the region in the wall portion other than the suction port. Thus, when the actuator performs bending vibrations, the flow rate of gas leaking from the air channel to outside the blower through the suction port is reduced even more, and the flow rate of gas colliding with the wall portion is increased even more.

As a result, when the actuator performs bending vibrations, the flow rate of gas drawn by the air flow moving out from the blower chamber through the vent hole increases even more, and the discharge flow rate of gas discharged from the discharge port increases even more.

The suction port preferably has a diameter of about one-half or less than a diameter of the driving member.

In this configuration, the discharge flow rate per power consumption is significantly increased more efficiently, and the necessary discharge flow rate is achieved even with low power consumption.

An actuator according to a preferred embodiment of the present invention preferably is configured to perform bending vibrations in a vibration mode of a third-order mode or higher odd-order mode producing a plurality of antinodes of vibrations by the driving member, and the suction port preferably is disposed in a region outside a location in the wall portion, the location facing a node of vibrations nearest a center of the actuator among nodes produced by the bending vibrations of the actuator.

In this configuration, the wall portion faces all of the region of high vibration energy in the actuator. Thus, when the actuator performs bending vibrations in the above-described vibration mode, the flow rate of gas leaking from the air channel to outside the blower through the suction port is reduced even more, and the flow rate of gas colliding with the wall portion is increased even more.

As a result, when the actuator performs bending vibrations in the above-described vibration mode, the flow rate of gas drawn by the air flow moving out from the blower chamber through the vent hole is increased even more, and the discharge flow rate of gas discharged from the discharge port is increased even more.

The wall portion including the suction port preferably is detachably mounted on the second housing.

In this configuration, the adjustment of the shape of the wall portion mounted on the second housing enables the discharge pressure and discharge flow rate to be adjusted without having to modify the configuration other than the wall portion.

According to various preferred embodiments of the present invention, the discharge flow rate per power consumption is significantly increased, and the necessary discharge flow rate is achieved even with low power consumption.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 5A and 5B are cross-sectional views of the piezoelectric blower 100 illustrated in FIG. 1 taken along the line S-S when the piezoelectric blower 100 operates at a first-order mode frequency (fundamental), wherein FIG. 5A illustrates a state where a blower chamber 36 has an increased volume, and FIG. 5B illustrates a state where the blower chamber 36 has a reduced volume.

FIGS. 6A and 6B are cross-sectional views of a piezoelectric blower 200 according to a second preferred embodiment of the present invention taken along the line S-S when the piezoelectric blower 200 operates at a third-order mode frequency (triple of the fundamental), wherein FIG. 6A illustrates a state where the blower chamber 36 has an increased volume, and FIG. 6B illustrates a state where the blower chamber 36 has a reduced volume.

FIG. 11A illustrates a state where the blower chamber 36 has an increased volume, and FIG. 11B illustrates a state where the blower chamber 36 has a reduced volume.

DETAILED DESCRIPTION OF THE PREFERRED EMBODIMENTS

First Preferred Embodiment

A piezoelectric blower 100 according to a first preferred embodiment of the present invention is described below.

Figure 1:
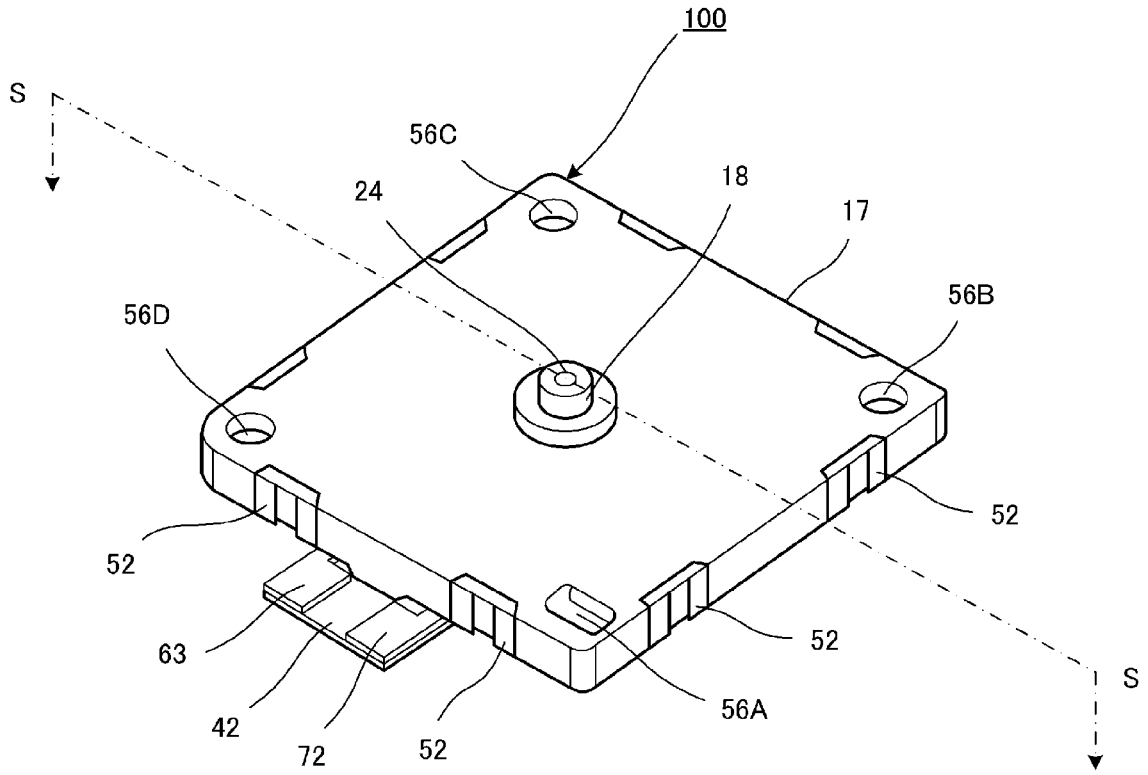
FIG. 1 is an external perspective view of a piezoelectric blower 100 according to a first preferred embodiment of the present invention.
Figure 2:
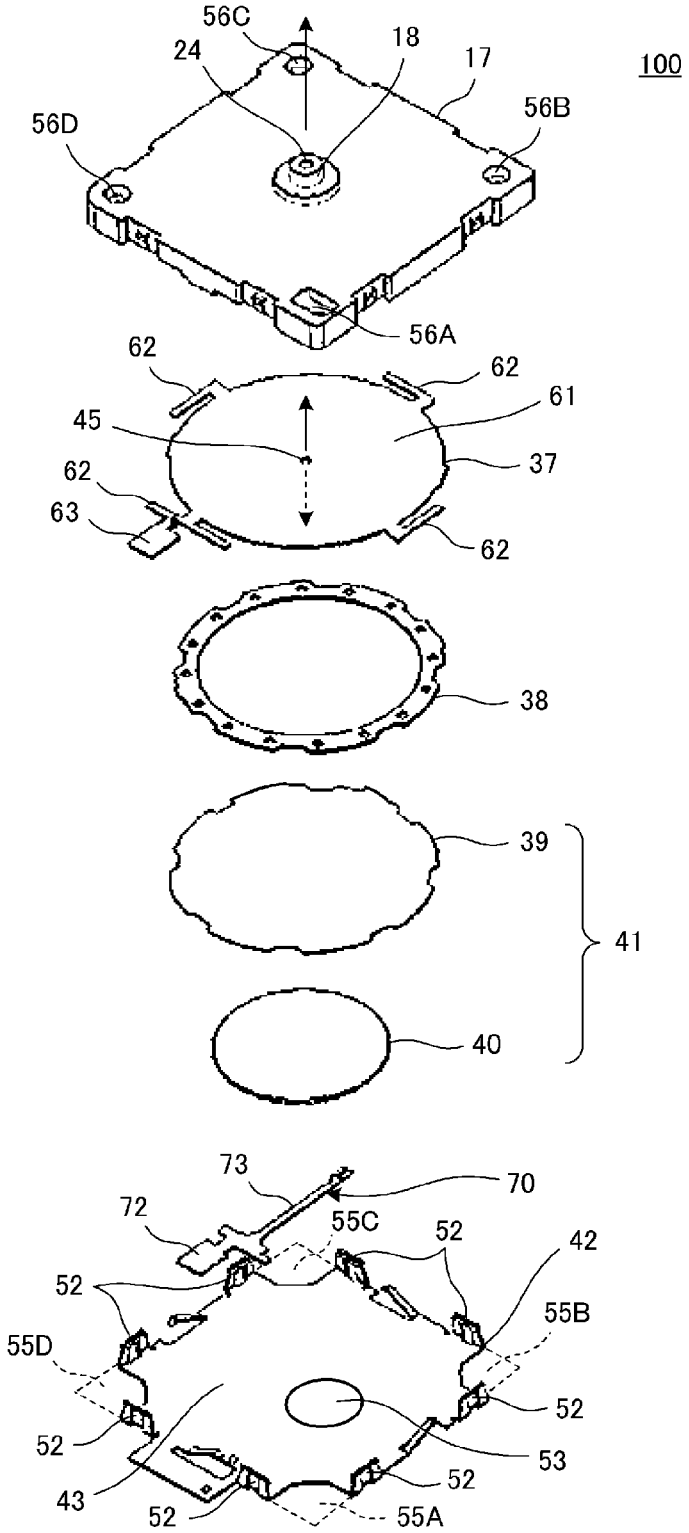
FIG. 2 is an exploded perspective view of the piezoelectric blower 100 illustrated in FIG. 1.
Figure 3:
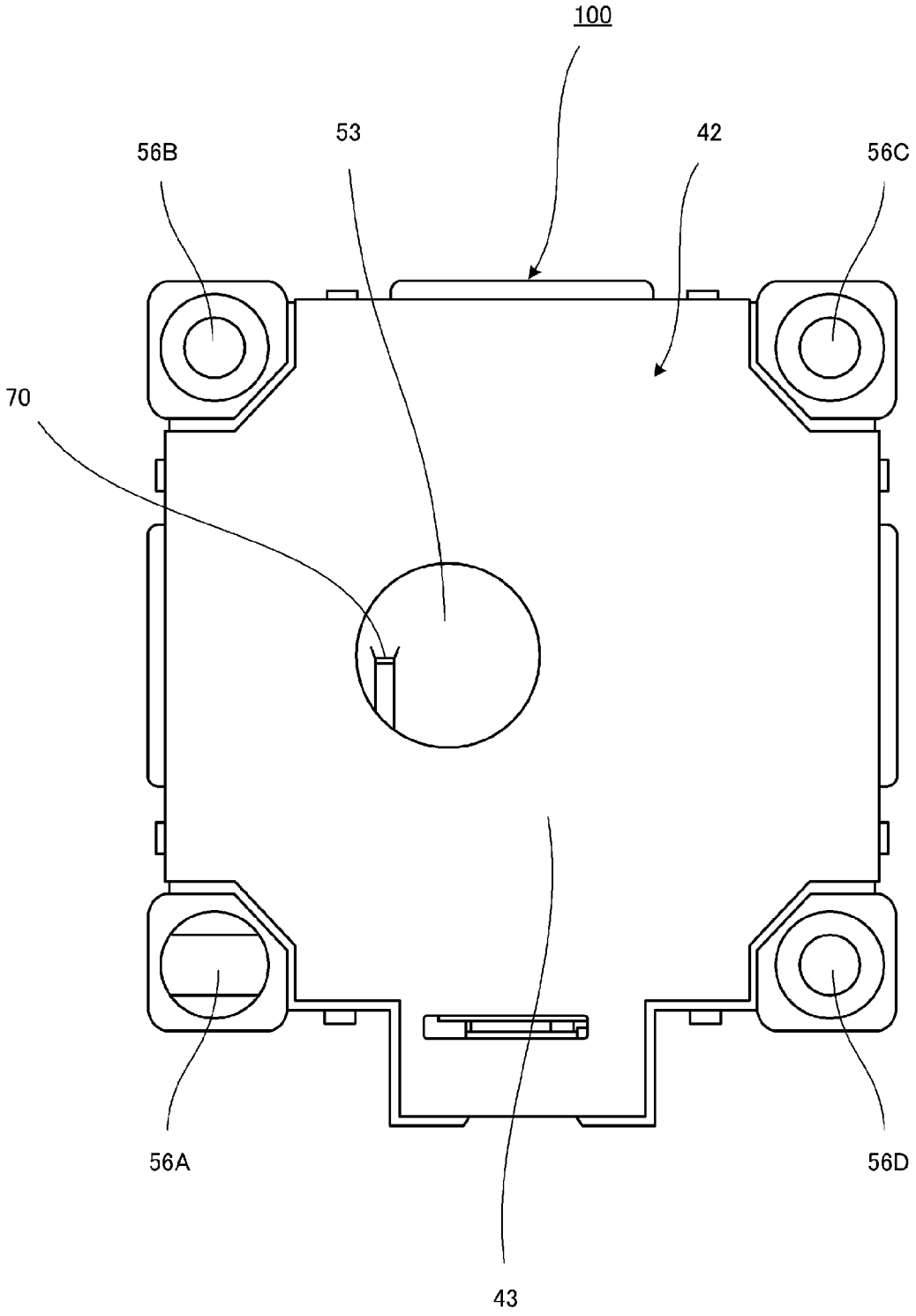
FIG. 3 is a bottom view of the piezoelectric blower 100 illustrated in FIG. 1.
Figure 4:
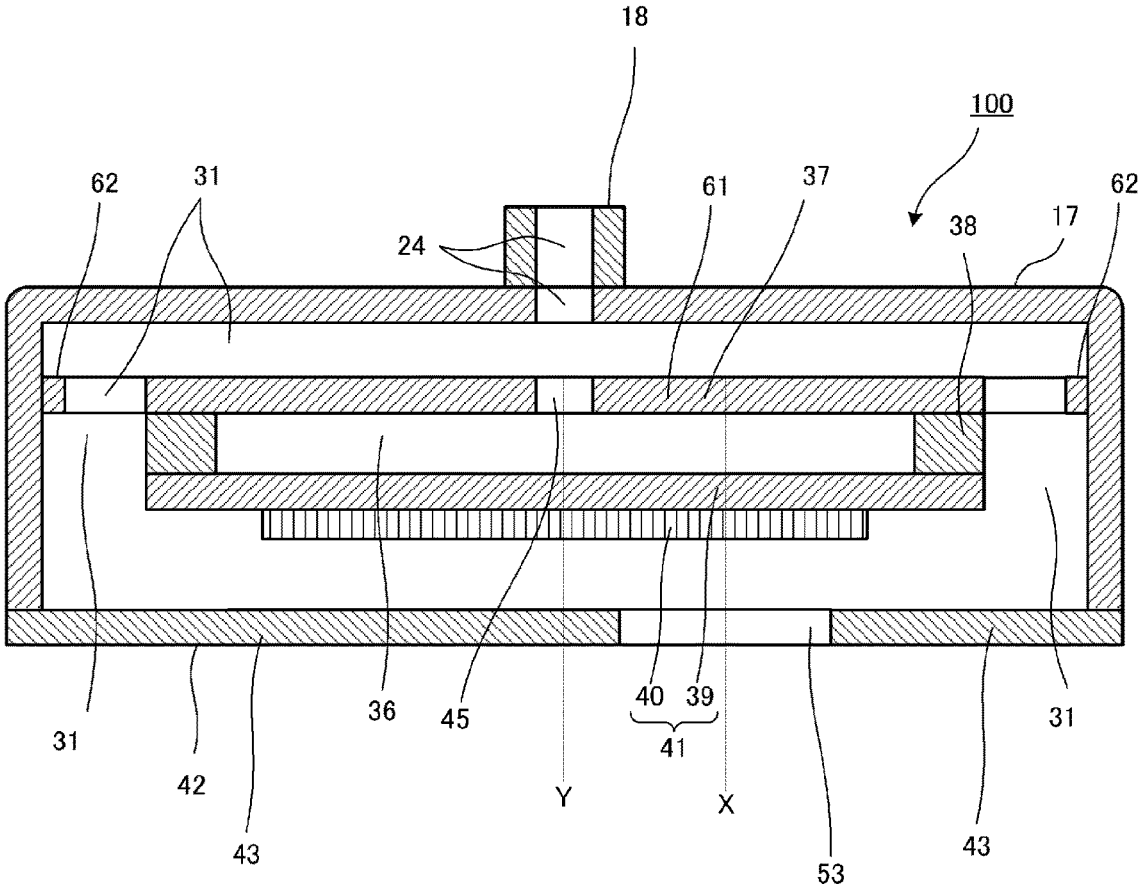
FIG. 4 is a cross-sectional view of the piezoelectric blower 100 illustrated in FIG. 1 taken along line S-S.

FIG. 1 is an external perspective view of the piezoelectric blower 100 according to the first preferred embodiment of the present invention. FIG. 2 is an exploded perspective view of the piezoelectric blower 100 illustrated in FIG. 1. FIG. 3 is a bottom view of the piezoelectric blower 100 illustrated in FIG. 1. FIG. 4 is a cross-sectional view of the piezoelectric blower 100 illustrated in FIG. 1 taken along line S-S.

The piezoelectric blower 100 includes a housing 17, a top plate 37, a side plate 38, a vibrating plate 39, a piezoelectric element 40, and a cap 42 in sequence from the above and has a structure in which they are stacked in sequence. The top plate 37, side plate 38, and vibrating plate 39 define a blower chamber 36. The piezoelectric blower 100 preferably has dimensions of about 20 mm in width×about 20 mm in length×about 1.85 mm in height in the region without a nozzle 18, for example.

In the present preferred embodiment, the joined structure of the top plate 37 and the side plate 38 corresponds to a "first housing", and the housing 17 corresponds to a "second housing". The piezoelectric element 40 corresponds to a "driving member".

The housing 17 includes the nozzle 18 including a discharge port 24. The discharge port 24 is configured to allow air to be discharged therethrough and is disposed in a central portion of the nozzle 18. The nozzle 18 preferably has dimensions of about 2.0 mm in outer diameter×about 0.8 mm in inner diameter (that is, a diameter of the discharge port 24)×about 1.6 mm in height, for example. The housing 17 preferably includes screw holes 56A to 56D at its four corners, for example.

The housing 17 has a rectangular or substantially rectangular U-shaped cross section that is open in its lower portion. The housing 17 accommodates the top plate 37 in the blower chamber 36, the side plate 38 in the blower chamber 36, the vibrating plate 39, and the piezoelectric element 40. The housing 17 may be made of, for example, resin.

The top plate 37 in the blower chamber 36 is disc-shaped and may be made of, for example, metal. The top plate 37 includes a central portion 61, protruding portions 62, and an external terminal 63. Each of the protruding portions 62 vertically protrudes from the central portion 61, is in contact with the inner wall of the housing 17, and is key-shaped. The external terminal 63 is preferably configured to connect to an external circuit.

The central portion 61 in the top plate 37 includes a vent hole 45 configured to enable the inside and outside of the blower chamber 36 to communicate with each other. The vent hole 45 is disposed in a location that faces the discharge port 24 in the housing 17. The top plate 37 is joined to the upper surface of the side plate 38.

The side plate 38 in the blower chamber 36 is ring-shaped and may be made of, for example, metal. The side plate 38 is joined to the upper surface of the vibrating plate 39. Thus, the thickness of the side plate 38 is the height of the blower chamber 36.

The vibrating plate 39 is disc-shaped and may be made of, for example, metal. The vibrating plate 39 constitutes the bottom surface of the blower chamber 36.

The piezoelectric element 40 is disc-shaped and may be made of, for example, a PZT-based ceramic. The piezoelectric element 40 preferably has a diameter of about 13.8 mm, for example. A principal surface of the piezoelectric element 40 that is near a wall portion 43 preferably has an area of about 150 $mm^2$, for example. The piezoelectric element 40 is joined to a principal surface of the vibrating plate 39 that is opposite to the blower chamber 36. The piezoelectric element 40 expands and contracts in accordance with an applied alternating voltage. The joined structure of the piezoelectric element 40 and the vibrating plate 39 constitute a piezoelectric actuator 41.

The joined structure of the top plate 37, side plate 38, vibrating plate 39, and piezoelectric element 40 is supported elastically on the housing 17 preferably by the four protruding portions 62 of the top plate 37, for example.

An electrode conduction plate 70 includes an internal terminal 73 to connect to the piezoelectric element 40 and an external terminal 72 to connect to an external circuit. The tip of the internal terminal 73 is soldered to a flat surface of the piezoelectric element 40. Positioning the soldering location at a location corresponding to a node of the bending vibrations of the piezoelectric element 40 enables the vibrations of the internal terminal 73 to be more reduced or prevented.

The cap 42 includes the wall portion 43, which faces the piezoelectric actuator 41, and includes a suction port 53 having a disc shape. In the present preferred embodiment, the distance between the wall portion 43 and the piezoelectric element 40 preferably is about 0.3 mm, for example. The thickness of the wall portion 43 preferably is about 0.1 mm, for example.

The diameter of the suction port 53 may be preferably about one-half or less than the diameter of the piezoelectric element 40 and preferably is about 5 mm in the present preferred embodiment, for example. The area of the opening surface of the suction port 53 preferably is about 19.6 $mm^2$, for example. The ratio of the area of the opening surface of the suction port 53 to the area of the principal surface of the piezoelectric element 40 near the wall portion 43 (area ratio) preferably is approximately 0.13, for example.

As illustrated in FIG. 4, the central axis X passing through the center of the suction port 53 and extending along the thickness direction of the wall portion 43 and the central axis Y passing through the center of the piezoelectric element 40 and extending along the thickness direction of the wall portion 43 do not coincide with each other. The cap 42 includes cuts 55A to 55D in locations corresponding to the screw holes 56A to 56D in the housing 17.

The cap 42 includes protruding portions 52 on its outer edge. The protruding portions 52 protrude toward the top plate 37. The cap 42 accommodates the top plate 37 in the blower chamber 36, the side plate 38 in the blower chamber 36, the vibrating plate 39, and the piezoelectric element 40, together with the housing 17, by holding the housing 17 using the protruding portions 52. The cap 42 may be made of, for example, glass epoxy resin.

As illustrated in FIG. 4, an air channel 31 is provided among the housing 17, the cap 42, and the joined structure of the top plate 37, side plate 38, and piezoelectric actuator 41.

Streams of air in the operating piezoelectric blower 100 are described below.

Figure 5A:
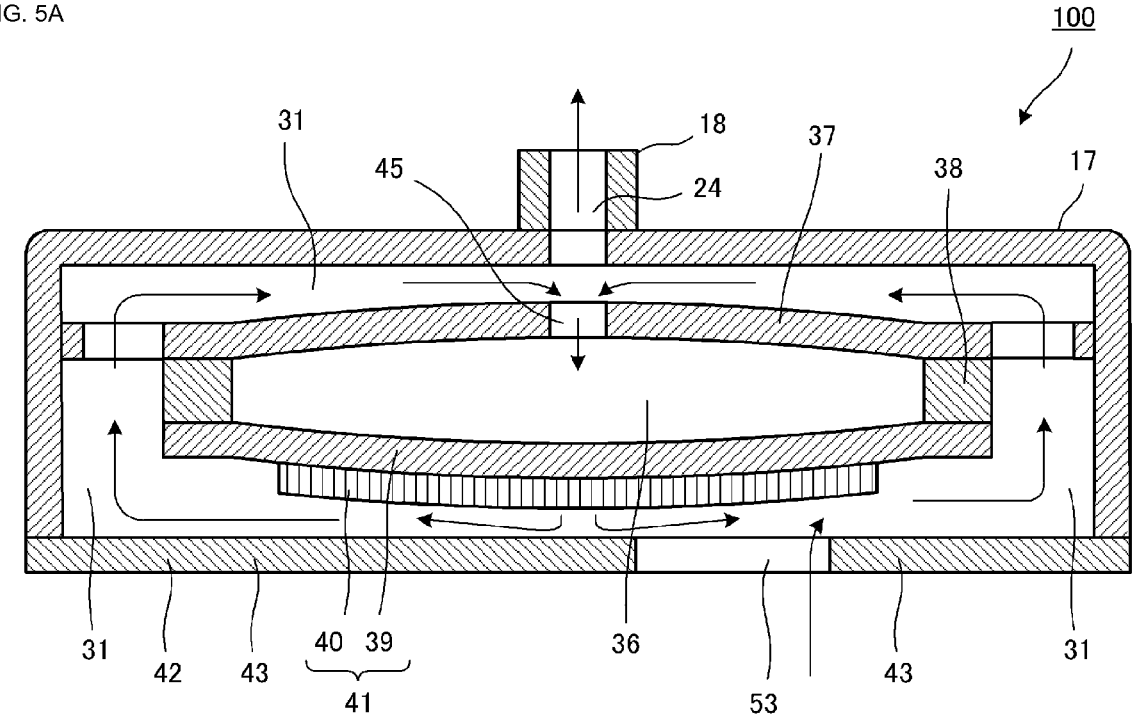
Figure 5B:
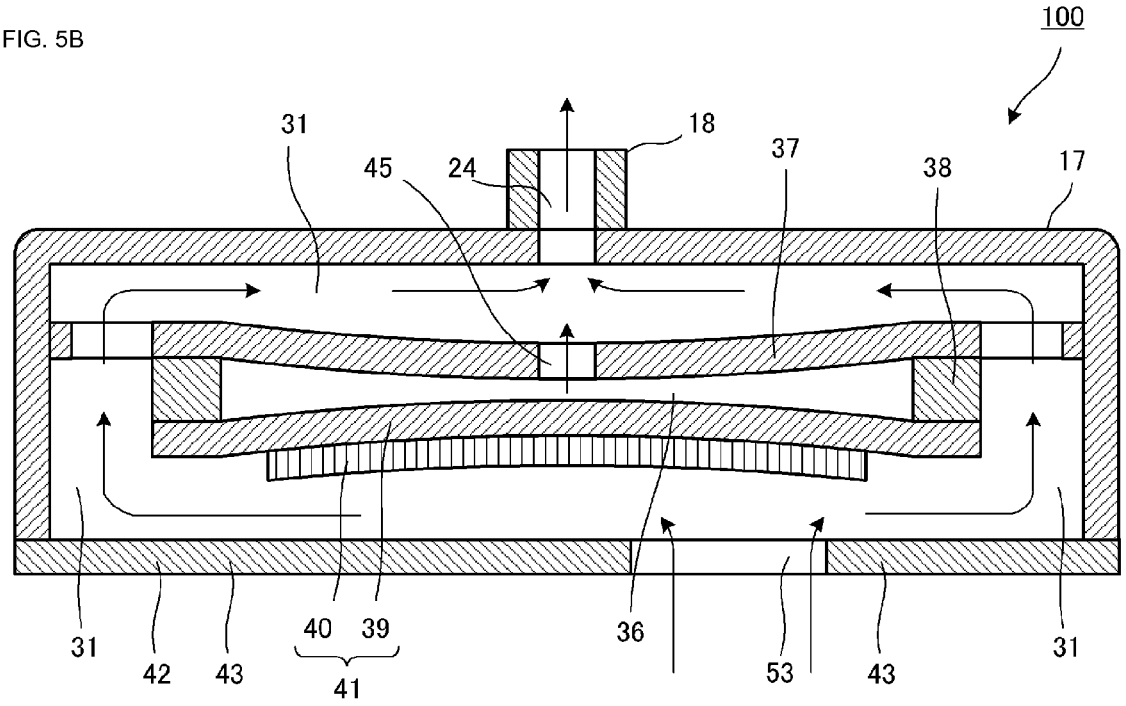

FIGS. 5A and 5B are cross-sectional views of the piezoelectric blower 100 illustrated in FIG. 1 taken along the line S-S when the piezoelectric blower 100 operates at a first-order mode frequency (hereinafter referred to as fundamental). FIG. 5A illustrates a state where the blower chamber 36 has an increased volume, and FIG. 5B illustrates a state where the blower chamber 36 has a reduced volume. Here, each of the arrows in the drawings indicates a course of air.

When an alternating drive voltage of the first-order mode frequency (fundamental) is applied from the external terminals 63 and 72 to the piezoelectric element 40 in the state illustrated in FIG. 4, the piezoelectric actuator 41 performs bending vibrations in a first-order mode in a concentric manner.

At the same time, because of pressure variations in the blower chamber 36 resulting from the bending vibrations of the piezoelectric actuator 41, the top plate 37 performs bending vibrations in a first-order mode in a concentric manner together with (in the present preferred embodiment, such that the vibration phase lags 180° or approximately 180° behind) the bending vibrations of the piezoelectric actuator 41.

Thus, as illustrated in FIGS. 5A and 5B, the vibrating plate 39 and top plate 37 are subjected to bending distortion, and the volume of the blower chamber 36 periodically changes.

As illustrated in FIG. 5A, when the alternating voltage is applied to the piezoelectric element 40 and the vibrating plate 39 is bent toward the piezoelectric element 40, the volume of the blower chamber 36 increases. With this action, air outside the piezoelectric blower 100 is sucked into the blower chamber 36 through the suction port 53, air channel 31, and vent hole 45. At this time, although there is no outflow of air from the blower chamber 36, inertial force of the air flow from the discharge port 24 to outside the piezoelectric blower 100 is present.

As illustrated in FIG. 5B, when the alternating voltage is applied to the piezoelectric element 40 and the vibrating plate 39 is bent toward the blower chamber 36, the volume of the blower chamber 36 is reduced. With this action, the air inside the blower chamber 36 is discharged from the discharge port 24 through the vent hole 45 and air channel 31.

At this time, the air flow discharged from the blower chamber 36 is discharged from the discharge port 24 while drawing the air outside the piezoelectric blower 100 through the suction port 53 and air channel 31. Accordingly, when the pressure applied from outside the piezoelectric blower 100 to the discharge hole is zero (hereinafter referred to as no load), the flow rate of air discharged from the discharge port 24 increases by the flow rate of the drawn air.

Figure 12:
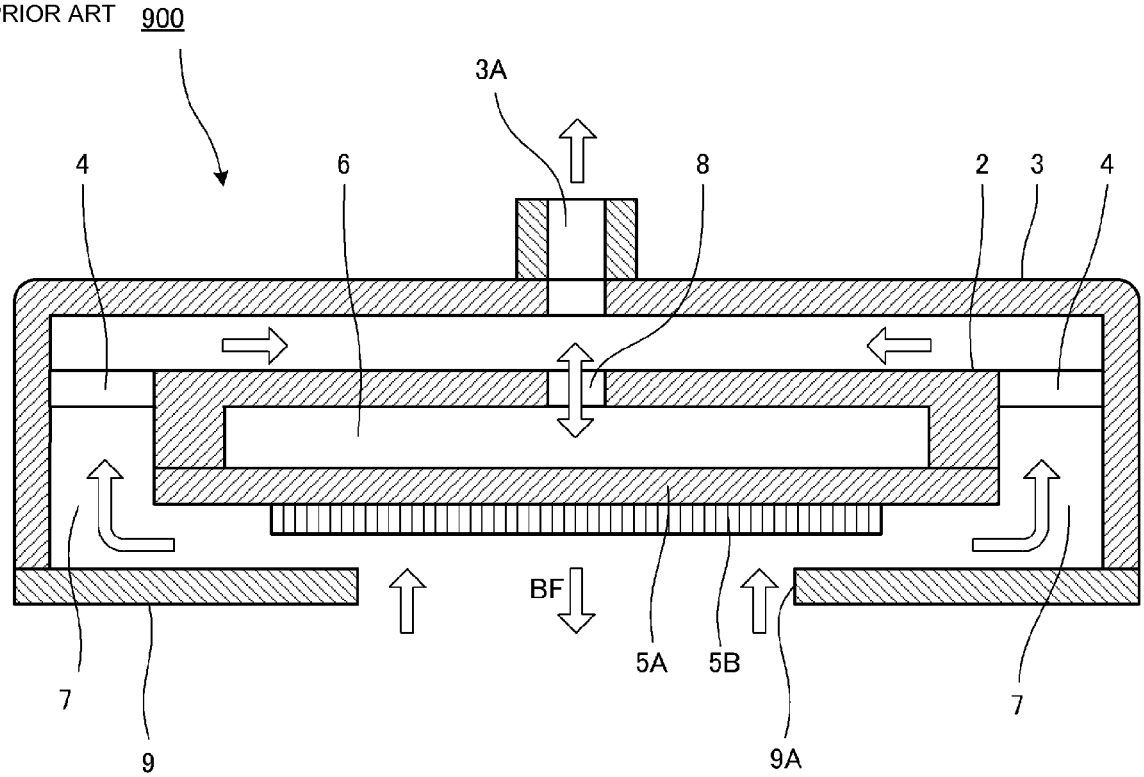
FIG. 12 PRIOR ART
FIG. 12 is a cross-sectional view of a micro-blower 900 according to Japanese Unexamined Patent Application Publication No. 2011-27079.

Here, as previously described, in the piezoelectric blower 100 of the present preferred embodiment, the central axis X passing through the center of the suction port 53 and the central axis Y passing through the center of the piezoelectric element 40 do not coincide with each other (see FIG. 4). Thus, the proportion of the area of the suction port 53 facing the region of high vibration energy in the piezoelectric actuator 41 (that is, the region of a large amount of displacement in the piezoelectric actuator 41) in the piezoelectric blower 100 according to the present preferred embodiment is lower than the corresponding one in the traditional micro-blower 900 (see FIG. 12), in which the central axis passing through the center of the suction port and the central axis passing through the center of the piezoelectric element coincide with each other.

In particular, in the piezoelectric blower 100 according to the present preferred embodiment, the center, which has the highest vibration energy, of the piezoelectric actuator (that is, the center, which has the largest amount of displacement, of the piezoelectric actuator 41) faces the region in the wall portion 43 other than the suction port 53.

Thus, when the piezoelectric actuator 41 performs bending vibrations, the flow rate of air leaking from the air channel 31 to outside the piezoelectric blower 100 through the suction port 53 decreases, and the flow rate of air colliding with the wall portion 43 increases.

As a result, as illustrated in FIG. 5A, the air flow colliding with the wall portion 43 and being spread remains in the air channel 31. Thus, the flow rate of air drawn by the air flow moving out from the blower chamber 36 through the vent hole 45 increases. That is, the discharge flow rate of air discharged from the discharge port 24 increases.

Accordingly, the piezoelectric blower 100 in the present preferred embodiment significantly increases the discharge flow rate per power consumption and achieves the necessary discharge flow rate even with low power consumption.

Second Preferred Embodiment

A piezoelectric blower 200 according to a second preferred embodiment of the present invention is described below.

Figure 6A:
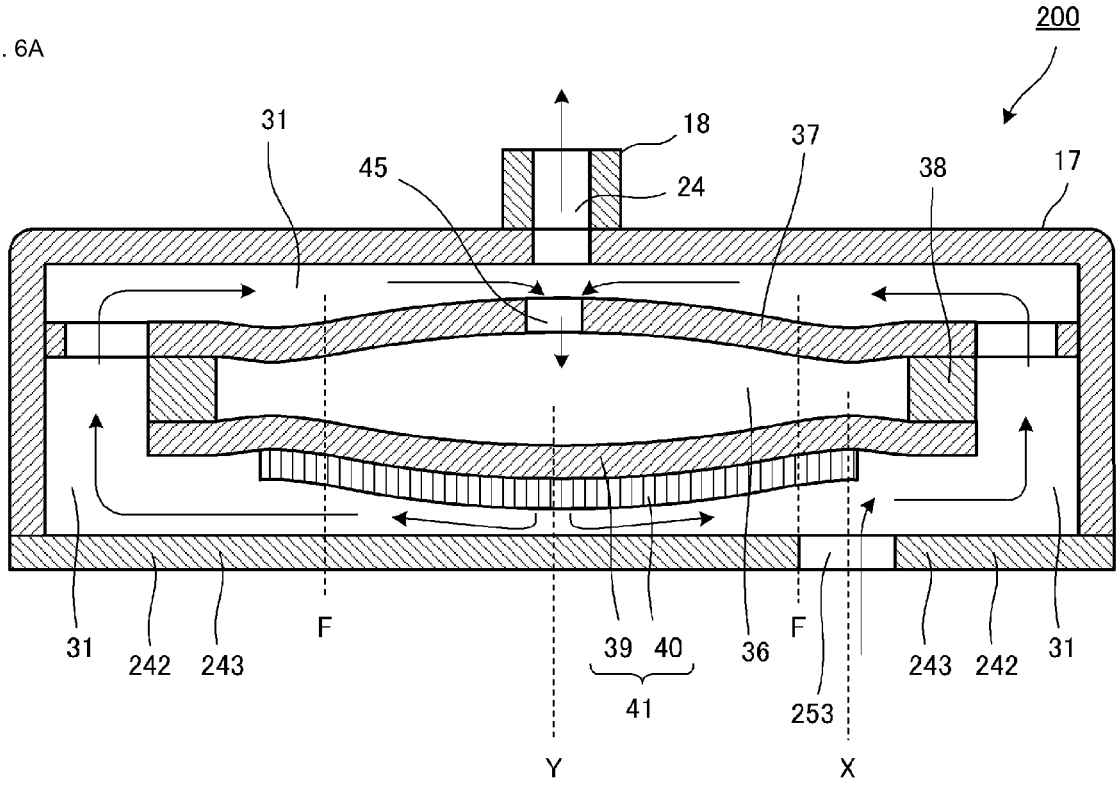
Figure 6B:
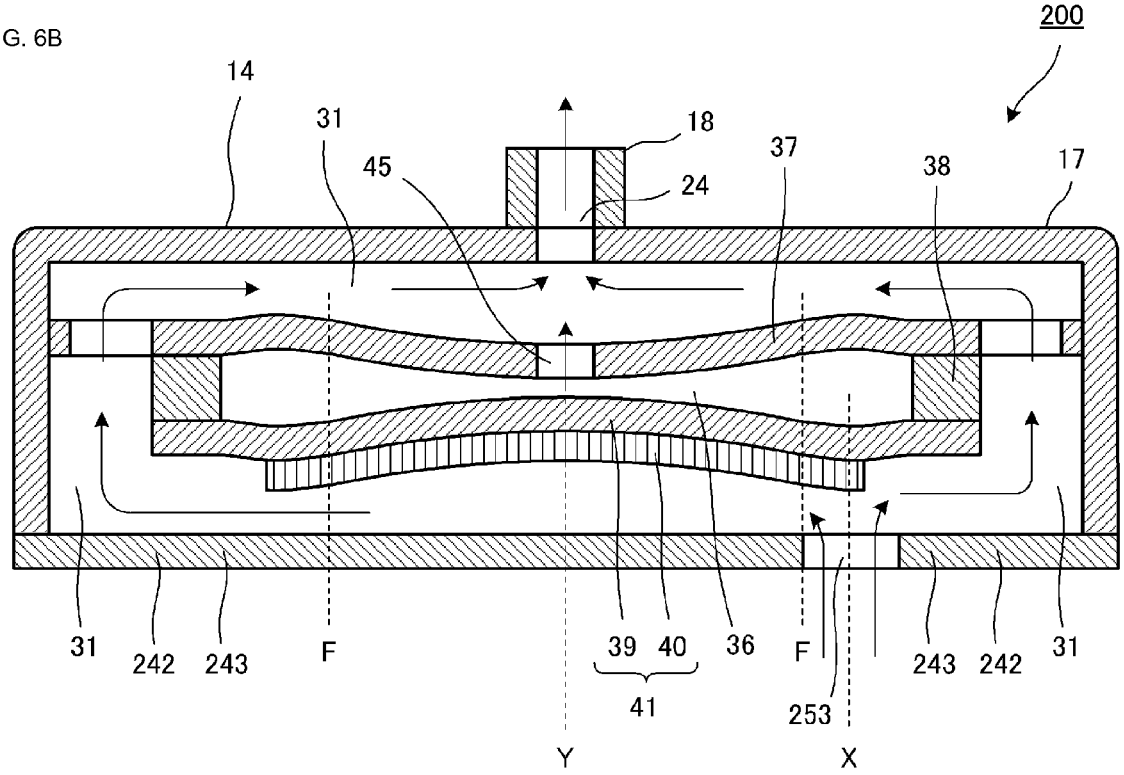
Figure 7:
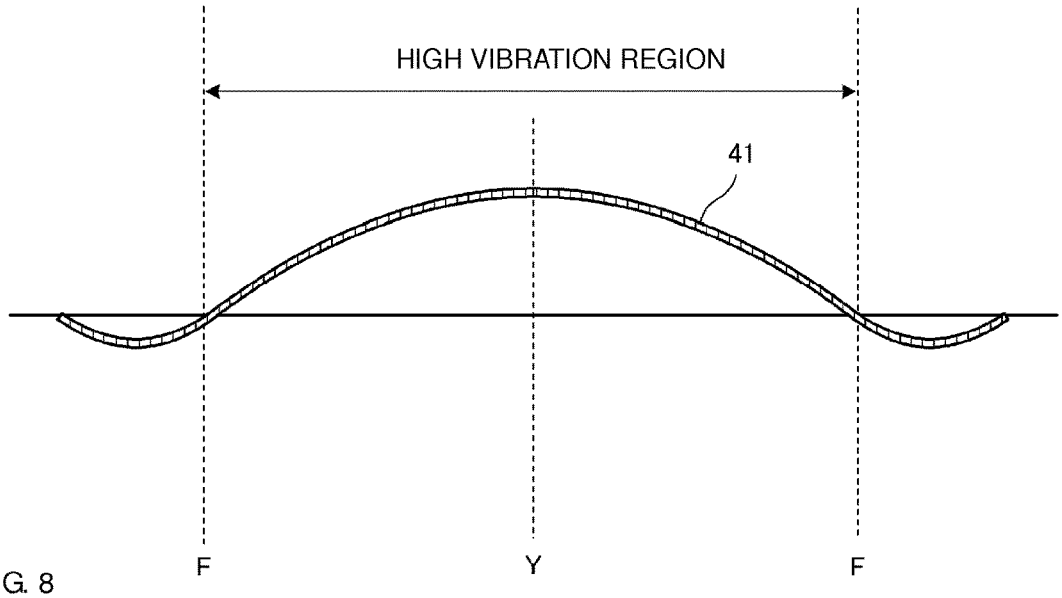
FIG. 7 is a schematic cross-sectional view of a piezoelectric actuator 41 illustrated in FIG. 6B.

FIGS. 6A and 6B are cross-sectional views of the piezoelectric blower 200 according to the second preferred embodiment of the present invention taken along the line S-S when the piezoelectric blower 200 operates at a third-order mode frequency (triple of the fundamental). FIG. 6A illustrates a state where the blower chamber 36 has an increased volume, and FIG. 6B illustrates a state where the blower chamber 36 has a reduced volume. FIG. 7 is a schematic cross-sectional view of the piezoelectric actuator 41 illustrated in FIG. 6B. FIG. 7 enhances the bending of the piezoelectric actuator 41 illustrated in FIG. 6B.

The piezoelectric blower 200 according to the second preferred embodiment differs from the piezoelectric blower 100 according to the above-described first preferred embodiment in a cap 242. The other configurations are preferably the same or substantially the same.

In detail, the cap 242 includes a disc-shaped suction port 253 in a region outside the location facing a node F of vibrations nearest the center of the piezoelectric actuator 41 among nodes produced by the bending vibrations of the piezoelectric actuator 41. The central axis X passing through the center of the suction port 253 and the central axis Y passing through the center of the piezoelectric element 40 do not coincide with each other. The other configurations are preferably the same or substantially the same as those in the cap 42.

Streams of air in the operating piezoelectric blower 200 are described below.

When an alternating drive voltage of the third-order mode frequency (triple of the fundamental) is applied from the external terminals 63 and 72 to the piezoelectric element 40 in the piezoelectric blower 200 according to the present preferred embodiment, the piezoelectric actuator 41 performs bending vibrations in a third-order mode producing one node F and two antinodes in a concentric manner.

At the same time, because of pressure variations in the blower chamber 36 resulting from the bending vibrations of the piezoelectric actuator 41, the top plate 37 performs bending vibrations in the same third-order mode in a concentric manner together with (in the present preferred embodiment, such that the vibration phase lags 180° behind) the bending vibrations of the piezoelectric actuator 41.

Thus, as illustrated in FIGS. 6A and 6B, the vibrating plate 39 and top plate 37 in the piezoelectric blower 200 are also subjected to bending distortion, and the volume of the blower chamber 36 periodically changes.

As illustrated in FIG. 6A, when the alternating voltage is applied to the piezoelectric element 40 and the vibrating plate 39 is bent toward the piezoelectric element 40, the volume of the blower chamber 36 increases. With this action, air outside the piezoelectric blower 200 is sucked into the blower chamber 36 through the suction port 253, air channel 31, and vent hole 45. At this time, although there is no outflow of air from the blower chamber 36, inertial force of the air flow from the discharge port 24 to outside the piezoelectric blower 200 is present.

As illustrated in FIG. 6B, when the alternating voltage is applied to the piezoelectric element 40 and the vibrating plate 39 is bent toward the blower chamber 36, the volume of the blower chamber 36 decreases. With this action, the air inside the blower chamber 36 is discharged from the discharge port 24 through the vent hole 45 and air channel 31.

At this time, the air flow discharged from the blower chamber 36 is discharged from the discharge port 24 while drawing the air outside the piezoelectric blower 200 through the suction port 253 and air channel 31. Accordingly, when the pressure applied from outside the piezoelectric blower 200 to the discharge hole is no load, the flow rate of air discharged from the discharge port 24 increases by the flow rate of the drawn air.

Here, in the piezoelectric blower 200 of the present preferred embodiment, the central axis X passing through the center of the suction port 253 and the central axis Y passing through the center of the piezoelectric element 40 do not coincide with each other (see FIGS. 6A and 6B). Thus, the proportion of the area of the suction port 253 facing the region of high vibration energy in the piezoelectric actuator 41 (that is, the region of a large amount of displacement in the piezoelectric actuator 41) in the piezoelectric blower 200 according to the present preferred embodiment is lower than the corresponding one in the traditional micro-blower 900 (see FIG. 12), in which the central axis passing through the center of the suction port and the central axis passing through the center of the piezoelectric element coincide with each other.

As illustrated in FIGS. 6A, 6B, and 7, in the piezoelectric blower 200 according to the present preferred embodiment, the suction port 253 is absent in a region in a wall portion 243, the region facing a high vibration region (that is, the region of high vibration energy) inside the node F of vibrations in the piezoelectric actuator 41.

In the piezoelectric blower 200 according to the present preferred embodiment, the center, which has the highest vibration energy, of the piezoelectric actuator 41 (that is, the center, which has the largest amount of displacement, of the piezoelectric actuator 41) faces the region in the wall portion 243 other than the suction port 253.

Thus, when the piezoelectric actuator 41 performs bending vibrations, the flow rate of air leaking from the air channel 31 to outside the piezoelectric blower 200 through the suction port 253 decreases, and the flow rate of air colliding with the wall portion 243 increases.

As a result, as illustrated in FIG. 6A, the air flow colliding with the wall portion 243 and being spread remains in the air channel 31. Thus, the flow rate of air drawn by the air flow moving out from the blower chamber 36 through the vent hole 45 increases. That is, the discharge flow rate of air discharged from the discharge port 24 increases.

Accordingly, the piezoelectric blower 200 according to the second preferred embodiment provides substantially the same advantages as the piezoelectric blower 200 in the above-described first preferred embodiment.

Next, the relationship between the distance from the central axis Y of the piezoelectric element 40 to the central axis X of the suction port 253 with respect to the central axis Y of the piezoelectric element 40 in the piezoelectric blower 200 and the pump characteristics (that is, discharge pressure and discharge flow rate) in the piezoelectric blower 200 is described.

Figure 8:
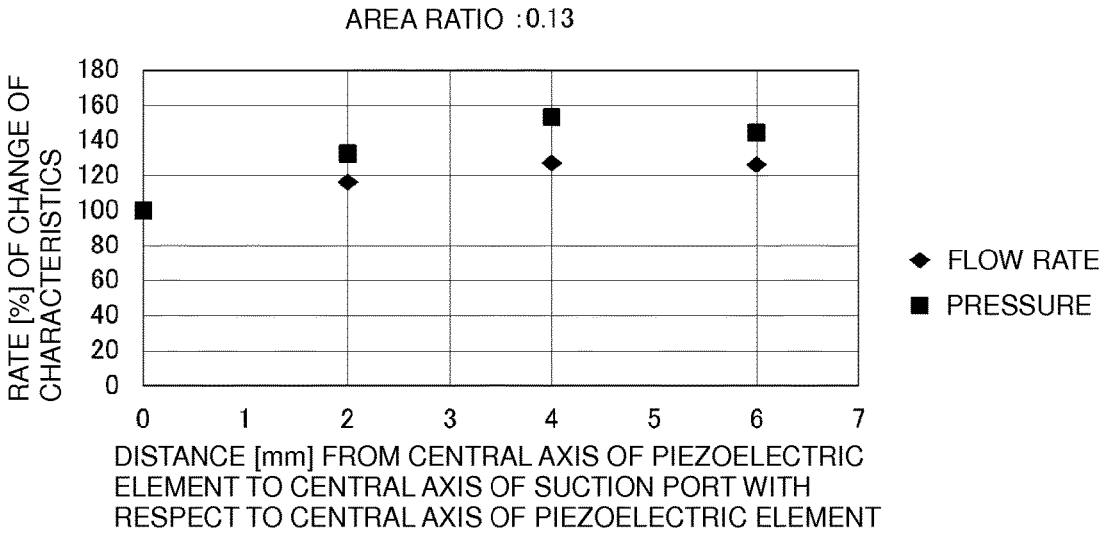
FIG. 8 illustrates a relationship between the distance from the central axis of a suction port 253 to the central axis of a piezoelectric element 40 in the piezoelectric blower 200 illustrated in FIGS. 6A and 6B and pump characteristics (discharge pressure and discharge flow rate) in the piezoelectric blower 200.

FIG. 8 illustrates the relationship between the distance from the central axis of the suction port 253 to the central axis of a piezoelectric element 40 in the piezoelectric blower 200 illustrated in FIGS. 6A and 6B and the pump characteristics (discharge pressure and discharge flow rate) in the piezoelectric blower 200. FIG. 8 illustrates a result of measurement of the discharge pressure and discharge flow rate in the piezoelectric blower 200 when the distance from the central axis Y of the piezoelectric element 40 to the central axis X of the suction port 253 is changed.

Here, the configuration where the distance from the central axis Y of the piezoelectric element 40 to the central axis X of the suction port 253 is zero indicates that the central axis X of the suction port 253 and the central axis Y of the piezoelectric element 40 illustrated in FIGS. 6A and 6B coincide with each other.

The result of measurement illustrated in FIG. 8 reveals that the discharge pressure and discharge flow rate in the piezoelectric blower 200 in which the distance from the central axis Y of the piezoelectric element 40 to the central axis X of the suction port 253 is increased are larger than the discharge pressure and discharge flow rate in the piezoelectric blower 200 in which the distance from the central axis Y of the piezoelectric element 40 to the central axis X of the suction port 253 is zero.

In particular, it is revealed that, when the discharge pressure and discharge flow rate in the piezoelectric blower 200 in which the distance from the central axis Y of the piezoelectric element 40 to the central axis X of the suction port 253 is zero are 100%, the discharge pressure in the piezoelectric blower 200 in which the distance from the central axis Y of the piezoelectric element 40 to the central axis X of the suction port 253 is about 4 mm is increased to about 155% and the discharge flow rate therein is also increased to about 125%, for example.

The reason for the above-described result is that the proportion of the area of the suction port 253 facing the region of high vibration energy in the piezoelectric actuator 41 (that is, the region of a large amount of displacement in the piezoelectric actuator 41) in the piezoelectric blower 200, in which the central axis X of the suction port 253 and the central axis Y of the piezoelectric element 40 do not coincide with each other, is lower than the corresponding one in a traditional piezoelectric blower in which the central axis of the suction port and the central axis of the piezoelectric element coincide with each other.

Third Preferred Embodiment

A piezoelectric blower 300 according to a third preferred embodiment of the present invention is described below.

Figure 9:
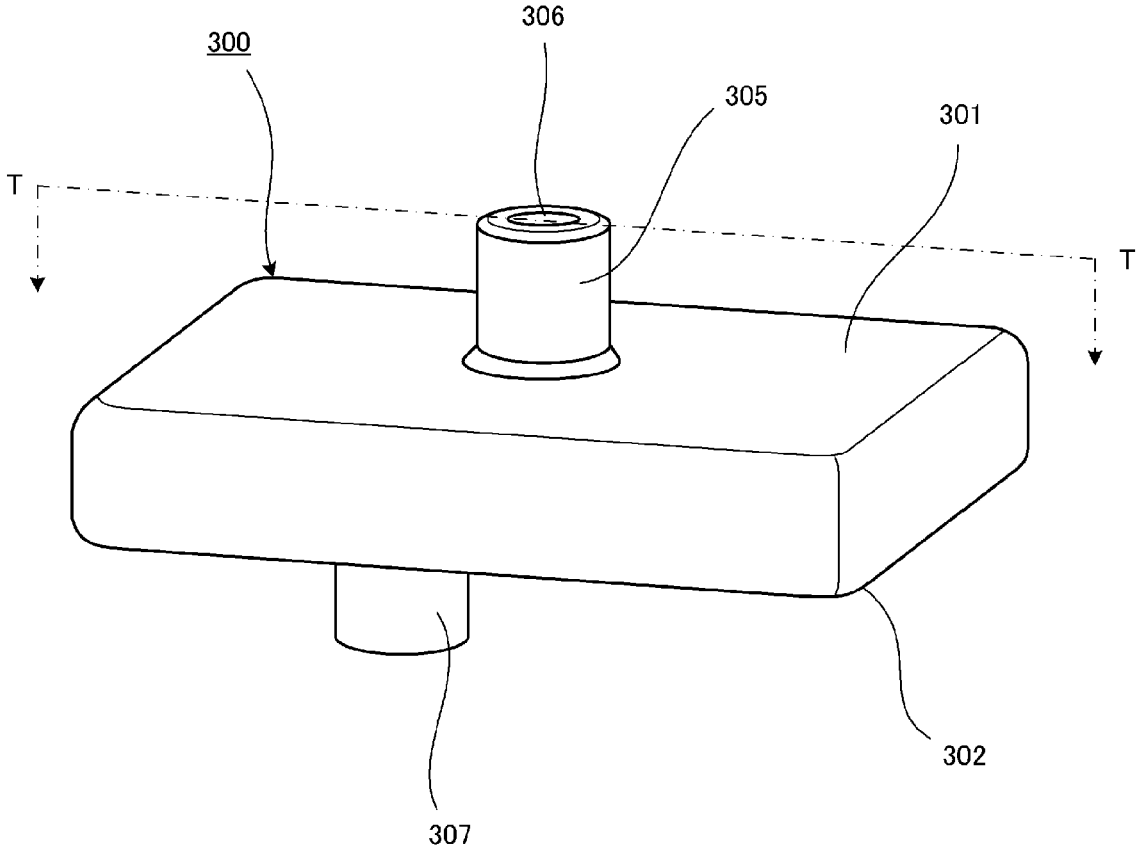
FIG. 9 is an external perspective view of a piezoelectric blower 300 according to a third preferred embodiment of the present invention.
Figure 10:
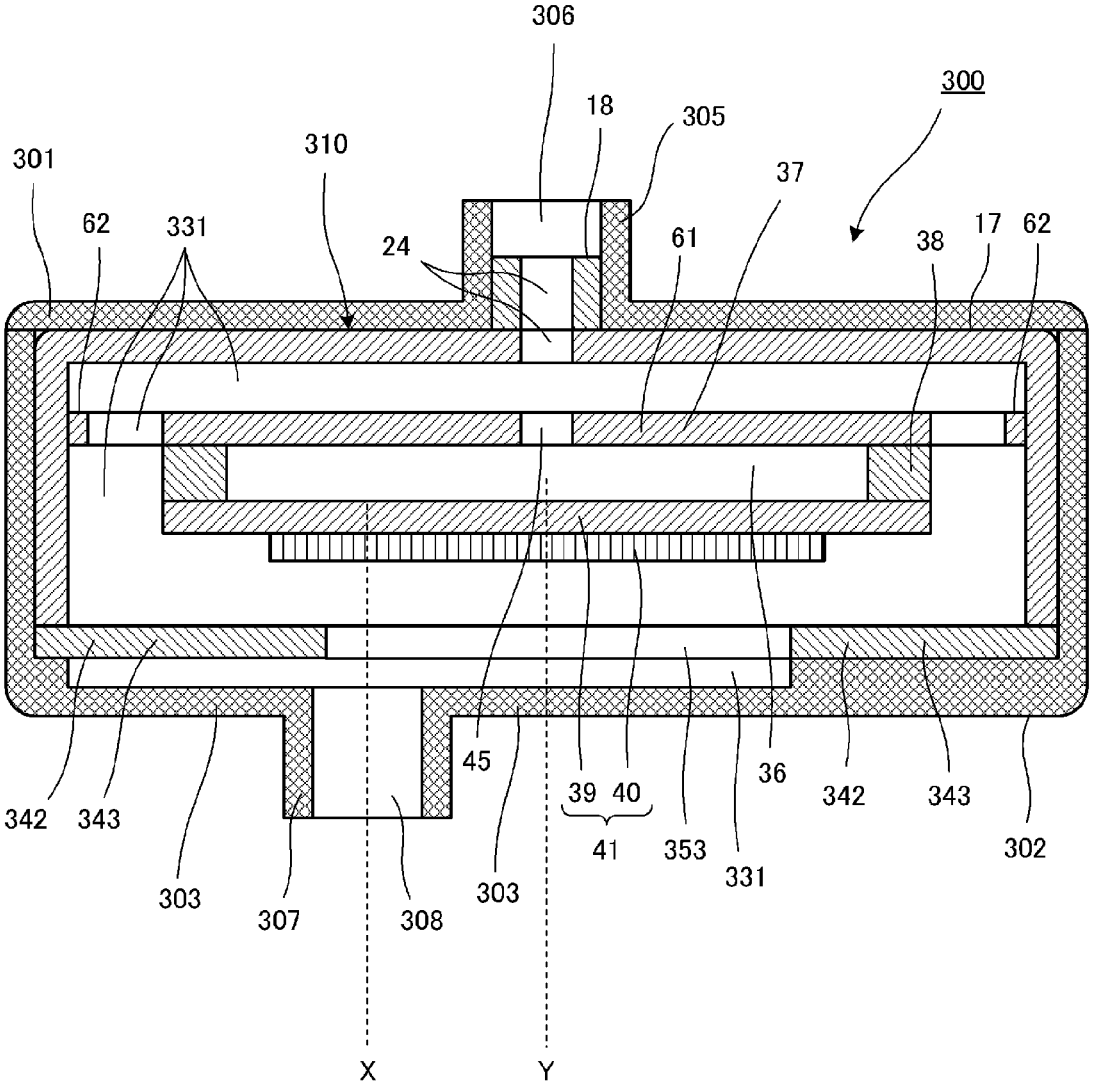
FIG. 10 is a cross-sectional view of the piezoelectric blower 300 illustrated in FIG. 9 taken along line T-T.

FIG. 9 is an external perspective view of the piezoelectric blower 300 according to the third preferred embodiment of the present invention. FIG. 10 is a cross-sectional view of the piezoelectric blower 300 illustrated in FIG. 9 taken along line T-T.

The piezoelectric blower 300 according to the third preferred embodiment differs from the piezoelectric blower 100 according to the above-described first preferred embodiment in a cap 342, a discharge-side casing 301, and a suction-side casing 302. The other configurations are preferably the same or substantially the same.

In detail, the piezoelectric blower 300 includes a main body 310, the discharge-side casing 301, and the suction-side casing 302. The main body 310 is a multilayer body preferably including the housing 17, top plate 37, side plate 38, vibrating plate 39, piezoelectric element 40, and cap 342.

The cap 342 includes a disc-shaped first suction port 353 whose central axis coincides with the central axis Y passing through the center of the piezoelectric element 40 and a first wall portion 343. The diameter of the first suction port 353 preferably is about 11 mm, for example. The area of the opening surface of the first suction port 353 preferably is about 95 $mm^2$, for example. The ratio of the area of the opening surface of the first suction port 353 to the area of the principal surface of the piezoelectric element 40 near the first wall portion 343 (area ratio) preferably is approximately 0.63, for example. The other configurations preferably are the same as those in the cap 42.

As previously described, the diameter of the piezoelectric element 40 preferably is about 13.8 mm, and the area of the principal surface of the piezoelectric element 40 near the wall portion 43 preferably is 150 $mm^2$, for example.

The discharge-side casing 301 includes a nozzle 305 including a cylindrical second discharge port 306 to discharge air therethrough. The second discharge port 306 is disposed in a central portion of the nozzle 305. The nozzle 305 surrounds the nozzle 18. The second discharge port 306 communicates with the first discharge port 24. The discharge-side casing 301 may be made of, for example, acrylic resin.

The suction-side casing 302 includes a nozzle 307 including a cylindrical second suction port 308 to suck air therethrough and a second wall portion 303 facing the piezoelectric actuator 41. The second suction port 308 is disposed in a central portion of the nozzle 307. Here, in the piezoelectric blower 300 according to the present preferred embodiment, the central axis X of the second suction port 308 in the second wall portion 303 in the suction-side casing 302 does not coincide with the central axis Y of the piezoelectric element 40. The suction-side casing 302 may be made of, for example, acrylic resin.

The diameter of the second suction port 308 may preferably be about one-half or less than the diameter of the piezoelectric element 40 and is preferably about 5 mm in the present preferred embodiment, for example. The area of the opening surface of the second suction port 308 preferably is about 19.6 $mm^2$, for example. The ratio of the area of the opening surface of the second suction port 308 to the area of the principal surface of the piezoelectric element 40 near the first wall portion 343 preferably is about 0.13, for example. The distance between the central axis X of the second suction port 308 and the central axis Y of the piezoelectric element 40 in the present preferred embodiment preferably is about 4 mm, for example.

The discharge-side casing 301 and suction-side casing 302 are joined to each other and detachably attached to the main body 310, and accommodates the main body 310. For example, the discharge-side casting301 and the suction-side casing 302 may be joined to one another using protruding portions similar to the protruding portions 52 shown in the non-limiting first preferred embodiment of FIG. 2. As illustrated in FIG. 10, an air channel 331 is provided among the joined structure of the top plate 37, side plate 38, and piezoelectric actuator 41, the housing 17, the cap 342, and the joined structure of the discharge-side casing 301 and suction-side casing 302.

In the present preferred embodiment, the joined structure of the top plate 37 and side plate 38 corresponds to a "first housing", and the joined structure of the housing 17 and cap 342 corresponds to a "second housing". The second wall portion 303 corresponds to a "wall portion".

Streams of air in the operating piezoelectric blower 300 are described below.

Figure 11A:
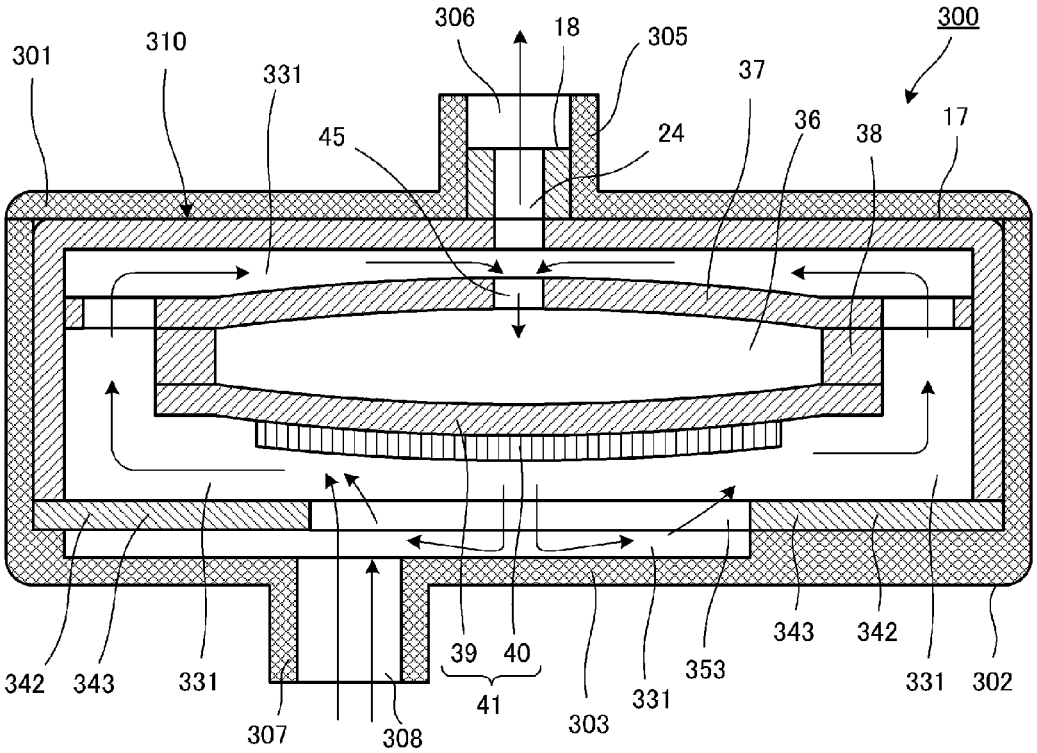
FIGS. 11A and 11B are cross-sectional views of the piezoelectric blower 300 illustrated in FIG. 9 taken along the line T-T when the piezoelectric blower 300 operates at a first-order mode frequency (fundamental)
Figure 11B:
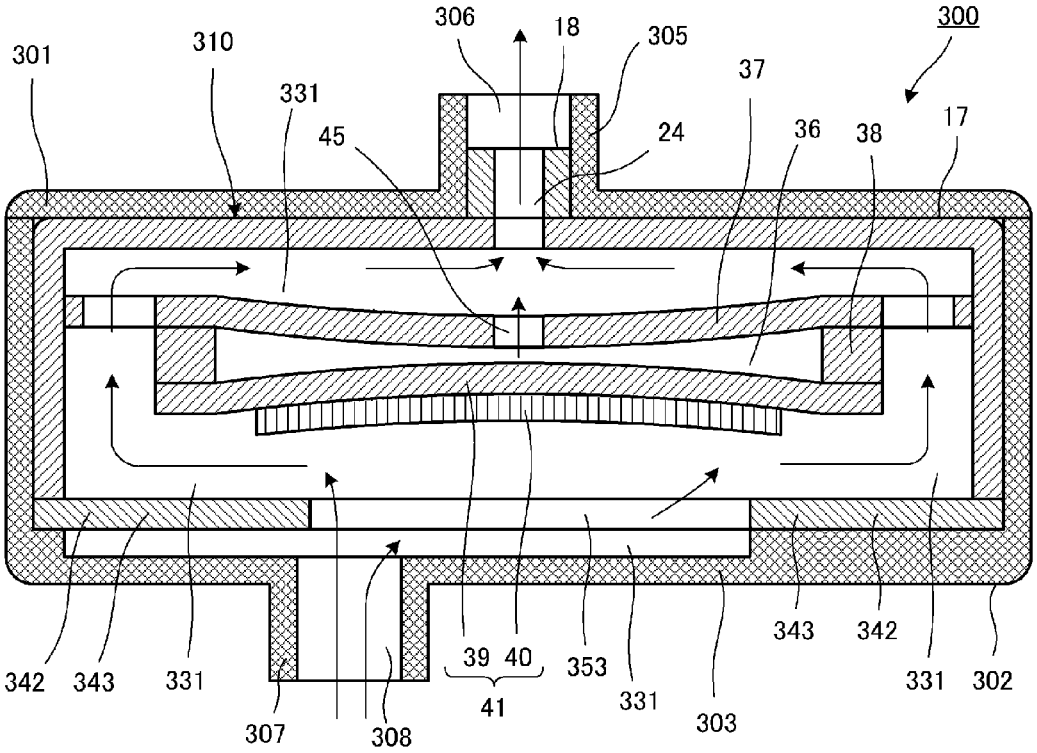

FIGS. 11A and 11B are cross-sectional views of the piezoelectric blower 300 illustrated in FIG. 9 taken along the line T-T when the piezoelectric blower 300 operates at a first-order mode frequency (fundamental). FIG. 11A illustrates a state where the blower chamber 36 has an increased volume, and FIG. 11B illustrates a state where the blower chamber 36 has a reduced volume.

When an alternating drive voltage of the first-order mode frequency (fundamental) is applied from the external terminals 63 and 72 to the piezoelectric element 40 in the state illustrated in FIG. 10, the piezoelectric actuator 41 performs bending vibrations in a concentric manner. At the same time, because of pressure variations in the blower chamber 36 resulting from the bending vibrations of the piezoelectric actuator 41, the top plate 37 performs bending vibrations in a concentric manner together with (in the present preferred embodiment, such that the vibration phase lags 180° or about 180° behind) the bending vibrations of the piezoelectric actuator 41.

Thus, as illustrated in FIGS. 11A and 11B, the vibrating plate 39 and top plate 37 are subjected to bending distortion, and the volume of the blower chamber 36 periodically changes.

As illustrated in FIG. 11A, when the alternating voltage is applied to the piezoelectric element 40 and the vibrating plate 39 is bent toward the piezoelectric element 40, the volume of the blower chamber 36 increases. With this action, air outside the piezoelectric blower 300 is sucked into the blower chamber 36 through the second suction port 308, air channel 331, and vent hole 45. At this time, although there is no outflow of air from the blower chamber 36, inertial force of the air flow from the second discharge port 306 to outside the piezoelectric blower 300 is present.

As illustrated in FIG. 11B, when the alternating voltage is applied to the piezoelectric element 40 and the vibrating plate 39 is bent toward the blower chamber 36, the volume of the blower chamber 36 decreases. With this action, the air inside the blower chamber 36 is discharged from the second discharge port 306 through the vent hole 45 and air channel 331.

At this time, the air flow discharged from the blower chamber 36 is discharged from the second discharge port 306 while drawing the air outside the piezoelectric blower 300 through the second suction port 308 and air channel 331. Accordingly, when the pressure applied from outside the piezoelectric blower 300 to the discharge hole is no load, the flow rate of air discharged from the second discharge port 306 increases by the flow rate of the drawn air.

Here, in the piezoelectric blower 300 of the present preferred embodiment, the central axis X passing through the center of the second suction port 308 in the suction-side casing 302 and the central axis Y passing through the center of the piezoelectric element 40 do not coincide with each other. Thus, the proportion of the area of the suction port facing the region of high vibration energy in the piezoelectric actuator 41 (that is, the region of a large amount of displacement in the piezoelectric actuator 41) in the piezoelectric blower 300 according to the present preferred embodiment is also lower than the corresponding one in the traditional micro-blower 900 (see FIG. 12), in which the central axis passing through the center of the suction port and the central axis passing through the center of the piezoelectric element coincide with each other.

In particular, in the piezoelectric blower 300 according to the present preferred embodiment, the center, which has the highest vibration energy, of the piezoelectric actuator 41 (that is, the center, which has the largest amount of displacement, of the piezoelectric actuator 41) faces the second wall portion 303.

Thus, when the piezoelectric actuator 41 performs bending vibrations, the flow rate of air leaking from the air channel 331 to outside the piezoelectric blower 300 through the second suction port 308 decreases, and the flow rate of air colliding with the second wall portion 303 increases.

As a result, as illustrated in FIG. 11A, the air flow colliding with the second wall portion 303 and being spread remains in the air channel 331. Thus, the flow rate of air drawn by the air flow moving out from the blower chamber 36 through the vent hole 45 increases. That is, the discharge flow rate of air discharged from the second discharge port 306 increases.

Accordingly, the piezoelectric blower 300 according to the third preferred embodiment provides substantially the same advantages as in the piezoelectric blower 100 in the above-described first preferred embodiment. For the relationship between the distance from the central axis Y of the piezoelectric element 40 and the central axis X of the second suction port 308 and the pump characteristics, substantially the same measurement result as in the piezoelectric blower 200 according to the above-described second preferred embodiment (see FIG. 8) is obtained in the piezoelectric blower 300 according to the third preferred embodiment.

In addition, according to the piezoelectric blower 300 according to the third preferred embodiment, the distance from the central axis Y of the piezoelectric element 40 to the central axis X of the second suction port 308 is capable of being changed without having to modify the configuration other than the second wall portion 303 (e.g., main body 310) by adjustment of the shape of the second wall portion 303 in the suction-side casing 302 mounted on the main body 310. That is, the discharge pressure and discharge flow rate are capable of being adjusted without having to modify the configuration other than the second wall portion 303 (e.g., main body 310) by the adjustment of the shape of the second wall portion 303.

Accordingly, any shape can be selected for each of the discharge-side casing 301 and suction-side casing 302 without changing the pump characteristics of the main body 310, and thus the versatility of use of the piezoelectric blower 300 is increased.

Other Preferred Embodiments

The above-described preferred embodiments preferably use air as fluid, for example. Other configurations may also be used. As the fluid, a gas other than air may also be used, for example.

The piezoelectric element 40 preferably is disposed as the source of driving the blower in the above-described preferred embodiments, for example. Other configurations may also be used. For example, the blower may also be configured as one that performs electromagnetically driven pumping.

The piezoelectric element 40 is preferably made of a PZT-based ceramic in the above-described preferred embodiments, for example. Other configurations may also be used. For example, it may also be made of a piezoelectric material of a non-lead piezoelectric ceramic, such as a potassium sodium niobate-based or alkali niobate-based ceramic.

A unimorph piezoelectric vibrator is preferably used in the above-described preferred embodiments, for example. Other configurations may also be used. A bimorph piezoelectric vibrator in which the piezoelectric element 40 is attached to each of both surfaces of the vibrating plate 39 may also be used.

The disc-shaped piezoelectric element 40, disc-shaped vibrating plate 39, and disc-shaped top plate 37 preferably are used in the above-described preferred embodiments, for example. Other configurations may also be used. For example, they may have a rectangular or polygonal shape.

The vibrating plate in the piezoelectric blower preferably is caused to perform bending vibrations at the first-order mode and the three-order mode frequencies in the above-described preferred embodiments, for example. Other configurations may also be used. In implementation, the vibrating plate may be caused to perform bending vibrations at the third-order mode or higher odd-order mode, which produces a plurality of antinodes of vibrations.

The top plate 37 preferably performs bending vibrations in a concentric manner together with the bending vibrations of the vibrating plate 39 in the above-described preferred embodiments. Other configurations may also be used. In implementation, only the vibrating plate 39 may perform bending vibrations, and the top plate 37 may not perform bending vibrations together with the bending vibrations of the vibrating plate 39.

Lastly, the description of the above preferred embodiments is to be considered in all respects only as illustrative and not restrictive. The scope of the present invention is, therefore, indicated by the appended claims rather than by the foregoing preferred embodiments. All changes which come within the meaning and range within the equivalency of the claims are to be embraced within their scope.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower comprising:

an actuator including a driving member and configured to perform bending vibrations in a concentric manner when a voltage is applied to the driving member;

a first housing including a vent hole, the first housing and the actuator defining a blower chamber, the first housing being configured to communicate an inside and outside of the blower chamber with each other;

a wall portion including only one suction port and facing the actuator;

a second housing covering the actuator and the first housing with the wall portion such that a gap is disposed therebetween; and an air channel provided among the second housing, the wall portion, the actuator, and the first housing; wherein the second housing includes a discharge port in a location facing the vent hole;

the suction port extends through the wall portion;

the first housing is directly connected to the second housing;

a central axis of the suction port and a central axis of the driving member do not coincide with each other;

at least a portion of the actuator opposes and overlaps the suction port in a direction that is parallel or substantially parallel to the central axis of the suction port;

the central axis of the suction port intersects a portion of the driving member; and the suction port includes only one opening extending through the wall portion.

2. The blower according to claim 1, wherein a center of the driving member faces a region in the wall portion other than the suction port.

3. The blower according to claim 1, wherein the suction port has a diameter, the driving member has a diameter, and a size of the diameter of the suction port is about one-half or less than a size of the diameter of the driving member.

4. The blower according to claim 1, wherein the actuator is configured to perform bending vibrations in a vibration mode of a third-order mode or higher odd-order mode to produce a plurality of antinodes of vibrations of the driving member; and the suction port is disposed in a region outside a location in the wall portion facing a node of vibrations nearest a center of the actuator among nodes produced by the bending vibrations of the actuator.

5. The blower according to claim 1, wherein the wall portion including the suction port is detachably mounted on the second housing.

6. The blower according to claim 1, wherein the actuator is a piezoelectric actuator.

7. The blower according to claim 1, wherein the first housing includes a top plate and a side plate.

8. The blower according to claim 7, wherein the second housing is configured to accommodate the top plate of the blower chamber, the side plate of the blower chamber, the driving member, and a vibrating plate.

9. The blower according to claim 1, wherein the blower chamber includes a lower surface defining a vibrating plate, and the driving member includes a piezoelectric element connected to the vibrating plate.

10. The blower according to claim 1, further comprising a cap that includes the wall portion and protruding portions on an outer edge thereof.

11. The blower according to claim 10, wherein the cap is configured to accommodate a top plate in the blower chamber, a side plate in the blower chamber, a vibrating plate, and the driving member, together with the second housing, by holding the second housing via the protruding portions.

12. The blower according to claim 1, further comprising a cap that includes the wall portion and the suction port; wherein the suction port is located in the wall portion outside of a region facing a node of vibrations nearest a center of the actuator among nodes produced by the bending vibrations of the actuator.

13. The blower according to claim 1, further comprising a cap, a discharge-side casing, and a suction-side casing; wherein the cap includes a wall portion and a suction port.

14. The blower according to claim 13, further comprising a main body including the second housing, a top plate and a side plate of the first housing, a vibrating plate, the driving member and the cap, wherein the discharge-side casing and the suction-side casing are joined to each other and detachably attached to the main body.

15. The blower according to claim 13, wherein the discharge-side casing includes a nozzle including a discharge port configured to discharge air.

16. The blower according to claim 13, wherein the suction-side casing includes a nozzle including a suction port configured to suck air.

17. The blower according to claim 1, wherein the first housing includes a top plate configured to perform bending vibrations.

18. The blower according to claim 17, wherein a vibration phase of the bending vibrations of the top plate lags 180° or approximately 180° behind a vibration phase of the bending vibrations of the actuator.

* * * * *